US008579089B2

(12) United States Patent
Hakala et al.

(10) Patent No.: US 8,579,089 B2
(45) Date of Patent: Nov. 12, 2013

(54) METHOD FOR CONTROLLING AN ELEVATOR, AND AN ELEVATOR USING STARTING POSITION DATA OF THE ELEVATOR AND SWAY DATA OF THE BUILDING

(71) Applicant: KONE Corporation, Helsinki (FI)

(72) Inventors: Tuomo Hakala, Espoo (FI); Sami Saarela, Helsinki (FI); Jaakko Kalliomäki, Vantaa (FI); Jarkko Saloranta, Helsinki (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 13/743,534

(22) Filed: Jan. 17, 2013

(65) Prior Publication Data

US 2013/0213742 A1 Aug. 22, 2013

(30) Foreign Application Priority Data

Feb. 16, 2012 (FI) ..... 20125178

(51) Int. Cl.
*B66B 1/28* (2006.01)

(52) U.S. Cl.
USPC ..... 187/293; 187/278; 187/391

(58) Field of Classification Search
USPC ..... 187/277, 278, 292–297, 380–388, 187/391–393
See application file for complete search history.

(56) References Cited

U.S. PATENT DOCUMENTS

| | | | | |
|---|---|---|---|---|
| 4,056,169 | A | 11/1977 | Showalter | |
| 7,905,329 | B2 * | 3/2011 | Urata | 187/384 |
| 7,926,620 | B2 * | 4/2011 | Amano | 187/278 |
| 8,118,140 | B2 * | 2/2012 | Kattainen et al. | 187/391 |
| 8,297,412 | B2 * | 10/2012 | Roberts et al. | 187/388 |
| 2009/0114484 | A1 | 5/2009 | Watanabe et al. | |
| 2013/0075199 | A1 * | 3/2013 | Kauppinen et al. | 187/247 |
| 2013/0075200 | A1 * | 3/2013 | Tenhunen | 187/276 |

FOREIGN PATENT DOCUMENTS

| | | | |
|---|---|---|---|
| JP | 2010-241532 | A | 10/2010 |
| WO | WO 2007/013434 | A1 | 2/2007 |
| WO | WO 2009/116986 | A1 | 9/2009 |

* cited by examiner

*Primary Examiner* — Anthony Salata
(74) *Attorney, Agent, or Firm* — Birch, Stewart, Kolasch & Birch, LLP

(57) ABSTRACT

A method for controlling an elevator installed in a building that includes an elevator car arranged to travel in a hoistway between floor landings that are at different heights, one or more ropings connected to the elevator car, a hoisting machine for moving the elevator car, and a control for control the hoisting machine is provided. In the method, the sway data of the building is determined, which data describes the strength of the sway of the building, and the starting position data of the elevator car is determined, which starting position data contains data about the starting position of the elevator car and/or data about how long the elevator car has been in the starting position, and the settings for the run speed of the next run are determined on the basis of the starting position data and the sway data. An elevator is configured to perform the method.

20 Claims, 2 Drawing Sheets

METHOD FOR CONTROLLING AN ELEVATOR, AND AN ELEVATOR USING STARTING POSITION DATA OF THE ELEVATOR AND SWAY DATA OF THE BUILDING

FIELD OF THE INVENTION

The object of the invention is a method for controlling an elevator, and an elevator, the elevator preferably being an elevator applicable to passenger transport and/or to freight transport.

BACKGROUND OF THE INVENTION

The invention relates to solving the problems caused by the rope sway of an elevator. A problem in elevators according to prior art, in which roping or ropings is/are connected to the elevator car, has been the sway of the ropes. These types of ropings are, inter alia, the suspension roping of the elevator car and possible compensating roping, which hangs while supported by the elevator car, e.g. between a possible counterweight and the elevator car. Swaying roping causes problems particularly during movement of the elevator car. Sway of the roping acts on the elevator car swinging the car in the lateral direction, owing to its laterally moving mass, which might be transmitted to a passenger, causing discomfort. Lateral forces can also exert additional loads on guide shoes, produce vibration or otherwise disrupt the movement of the car. A swaying rope also produces vertical vibration in the elevator car. At worst, rope sway can result in a dangerous situation, because a strongly swaying rope can in theory become entangled in the structures of the hoistway or even jump out of the groove of a diverting pulley. Minor vibration of the elevator car, although it could be harmless, causes discomfort to passengers and concern about the operation of the elevator. For these reasons, an elevator in solutions according to prior art has been taken out of service during strong swaying. This has been implemented such that sway of the ropings of the elevator has been determined, and when the sway exceeds a limit value, the next run of the elevator car has been prevented until the sway returns back to below the limit value. A problem in solutions according to prior art has been, inter alia, awkward measuring of rope sway directly from the ropes. On the other hand, indirect measurement has also been used, but the solutions have been complicated and in them the elevator has also sometimes been taken out of service unnecessarily. A need has, in fact, arisen for a more advanced solution for preparing for situations of sway of the roping of an elevator.

BRIEF DESCRIPTION OF THE INVENTION

The aim of the present invention is to solve the aforementioned problems of prior-art solutions as well as the problems disclosed in the description of the invention below. The aim is thus to produce an elevator in which, for avoiding the problems caused by sway of the roping, the run speed of the elevator car can be influenced better according to the actual need, avoiding unnecessary removals of the elevator from a run and avoiding unnecessary speed reductions. Among other things, some embodiments will be disclosed in which avoiding such unnecessary speed reductions can be implemented without measuring the sway directly from the ropes of the roping.

The invention is based on the concept that if the settings for the run speed of the next run of the elevator car are determined on the basis of the starting position data and the sway data of the building, the movement of the elevator car can very simply be limited in situations in which limiting is necessary and it can drive normally in situations in which limiting is not necessary. This can be implemented simply, because the method/elevator according to the invention does not require exact knowledge of the amount of sway of the roping. When taking the aforementioned variables roughly into account, a level can be reached that is adequate for avoiding at least the most obviously unnecessary removals of an elevator from a run or slowdowns of the run speed of the elevator.

In the method according to the invention for controlling an elevator installed in a building, which elevator comprises an elevator car, which is arranged to travel in the elevator hoistway between floor landings that are at different heights, roping connected to the elevator car, suspended on which roping the elevator car is suspended, a hoisting machine for moving the elevator car, control means for controlling the hoisting machine, these phases are performed:

a) the sway data of the building is determined, which data describes the strength of the sway of the building, preferably by measuring the sway of the building (e.g. the amplitude and/or frequency of the sway of the building) or the excitation of the sway of the building (e.g. wind), and b) the starting position data of the elevator car is determined, which starting position data contains data about the starting position of the elevator car and/or data about how long the elevator car has been in the starting position, and c) after performing phases a and b, the settings for the run speed of the next run are determined on the basis of the starting position data and the sway data of the building.

In this way the aforementioned advantages, among others, are achieved.

In a preferred embodiment in phase c the maximum speed of the next run and/or the final deceleration of the next run are set for the elevator car on the basis of the starting position data and the sway data. Changing, more particularly, reducing, these speed settings can assist in suppressing the sway of the roping and can reduce the vibration in the car caused by sway.

In a preferred embodiment in phase a the sway of the building or the excitation of the sway is measured for determining the sway data of the building, preferably measuring the amplitude and/or frequency of the sway, or the wind speed.

Determination of the sway of the roping can thus be performed indirectly without awkward monitoring of the roping. More particularly the amplitude and/or frequency of the sway well describe the strength of the sway of the building. It is also simple to compare the values of these variables to limit values and it is simple to take these variables as part of a simulation, with which the limit values can be determined.

In a preferred embodiment in phase a the sway of the building is measured with an acceleration sensor. Thus it is simple to ascertain the amplitude and frequency of the sway of the building. The acceleration sensor is preferably in the top parts of the building, preferably in the proximity of the top end of the range of movement of the elevator car.

In a preferred embodiment in phase c a reduced maximum speed of the next run and/or a reduced final deceleration of the next run are set for the elevator car, if the determined value of the sway data (e.g. it exceeds the limit value) and the starting position data (preferably the starting position and/or the stopover time of the car in the starting position) simultaneously fulfill certain criteria. In this way it can quickly and easily be assessed whether there is a need to reduce the values of the speed settings owing to sway of the roping.

In a preferred embodiment in phase c a reduced maximum speed of the next run and/or a reduced final deceleration of the next run are set for the elevator car, if the determined value of the sway data exceeds the limit value (e.g. it exceeds a predefined value) and the car position data simultaneously indicates that the elevator car is, or has been before the car starts to move, stopped for a certain time at the bottom end or top end of its range of movement (e.g. of the elevator hoistway), preferably at the point of the bottommost floor landing or at the point of the topmost floor landing. If this condition is not fulfilled, an unreduced maximum speed of the run and/or a reduced final deceleration of the next run can be set for the elevator car. The ends of the ranges of movement are the most problematic from the viewpoint of sway of the roping. Just by paying particular attention to these, unnecessary reductions of the settings for speed can be significantly reduced. In one preferred embodiment the aforementioned bottommost or topmost floor landing is a lobby floor. An elevator spends a lot of time in the lobby. If the lobby is in a problematic area from the viewpoint of sway, there is a high risk that sway will occur in the ropes.

In a preferred embodiment before phase c the determined sway data is compared to a limit value, the magnitude of which limit value is selected on the basis of starting position from a plurality of limit values on the basis of the starting position data, which plurality of limit values is preferably such that the limit value is lower with a starting position of the elevator car which is at the bottom end or at the top end of the range of movement of the elevator car (preferably at the point of the bottommost floor landing or topmost floor landing) than with a starting position which is between the bottom end and top end of the range of movement of the elevator car. The particular sensitivity of the ends of the ranges of movement to sway of the roping will in this way be taken into account.

In a preferred embodiment these are set for the elevator car a reduced maximum speed of the next run and/or a reduced final deceleration of the next run, if the determined value of the sway data exceeds the limit value and the starting position data simultaneously indicates that the elevator car is, or has been before the car starts to move, stopped for a certain time at the bottom end or top end of its range of movement, preferably at the point of the bottommost floor landing or at the point of the topmost floor landing, and an unreduced maximum speed and/or an unreduced final deceleration of the next run if the determined value of the sway data exceeds the limit value but the starting position data simultaneously does not indicate that the elevator car is, or has been before the car starts to move, stopped for a certain time at the bottom end or top end of its range of movement, and/or if the value of the sway data does not exceed a predefined value.

The elevator according to the invention is installed in a building, which elevator comprises an elevator car, which is arranged to travel in the elevator hoistway between floor landings that are at different heights, roping, which is connected to the elevator car, a hoisting machine for moving the elevator car, control means for controlling the hoisting machine, which control means are configured to control the speed of the elevator car, means for determining the sway data of the building, which sway data describes the strength of the sway of the building, and means for determining the starting position data of the car, which starting position data contains data about the starting position of the car and/or data about how long the car has been in the starting position. The control means are configured to determine the settings for the run speed of the next run on the basis of the aforementioned starting position data and the aforementioned sway data.

In a preferred embodiment the control means are configured to set for the elevator car the maximum speed of the next run and/or the final deceleration of the next run on the basis of the aforementioned starting position data and sway data.

In a preferred embodiment the control means are configured to set a reduced maximum speed for the elevator car, if the determined sway data and car position data simultaneously fulfill certain criteria.

In a preferred embodiment the control means are configured to perform a method according to any of those defined above.

In a preferred embodiment the control means comprise a logic for selecting the speed settings of the next run on the basis of sway data and of car position.

In a preferred embodiment the control means comprise a memory, which stores the speed settings of the elevator car as a function of sway data and of car position (possible starting positions).

In a preferred embodiment the elevator car is suspended supported on the aforementioned roping.

Preferably in the embodiments presented an unreduced maximum speed and an unreduced final deceleration of the next run are set for the elevator car if the criteria for starting position data and sway data are not fulfilled. Preferably these unreduced speed settings are set if the determined value of the sway data exceeds the limit value but the starting position data simultaneously does not indicate that the elevator car is, or has been before the car starts to move, stopped for a certain time at the bottom end or top end of its range of movement, and/or if the value of the sway data does not exceed a predefined value. Preferably the unreduced maximum speed is the nominal speed of the elevator. The solution can, however, be arranged to be such that a reduced maximum speed of the next run and/or an unreduced final deceleration of the next run are also set if the determined value of the sway data exceeds by an adequate amount the aforementioned limit value for sway data (e.g. it exceeds also a second limit value that is higher than the aforementioned limit value), although the car position data simultaneously does not indicate that the elevator car is, or has been before the car starts to move, a certain time at the bottom end or top end of its range of movement.

The elevator is most preferably an elevator applicable to the transporting of people and/or of freight, which elevator is installed in a building, to travel in a vertical, or at least essentially vertical, direction, preferably on the basis of landing calls and/or car calls. The elevator car preferably has an interior space, which is suited to receive a passenger or a number of passengers. The elevator preferably comprises at least two, possibly more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
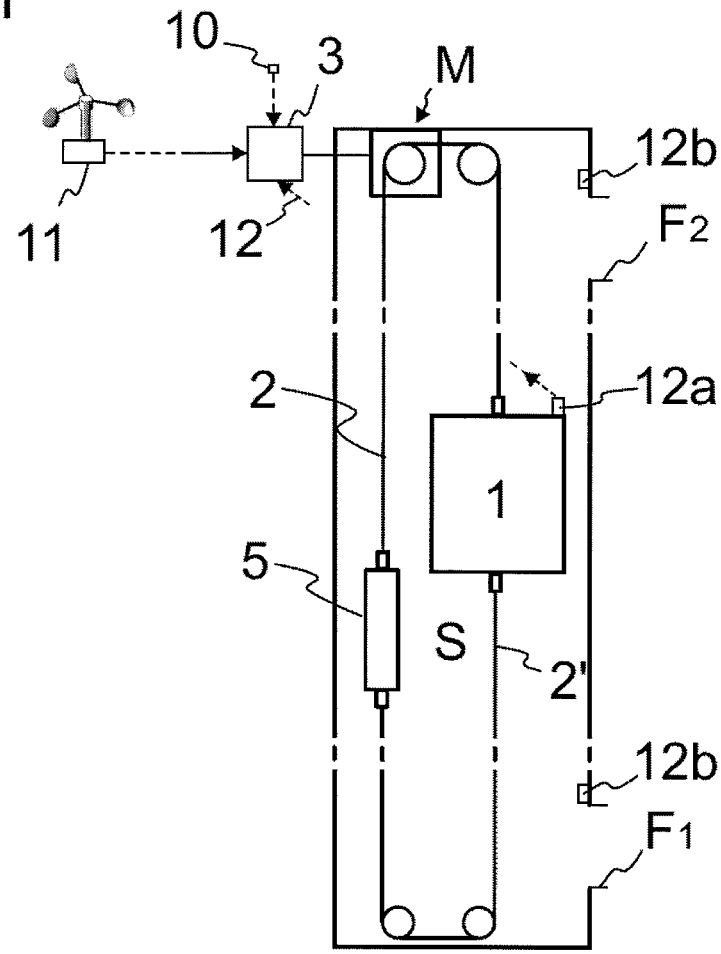
FIG. 1 presents one preferred embodiment of an elevator according to the invention, wherein the method according to the invention can be utilized.

The elevator of FIG. 1 comprises an elevator car 1, which is arranged to travel in the elevator hoistway S between floor landings $F_1$, $F_2$ that are at different heights. The elevator presented also comprises a counterweight 5. Connected to the elevator car 1 is roping 2, supported by which the elevator car 1 is suspended, as well as roping 2', which hangs supported by the elevator car 1 and the counterweight 5. The elevator further comprises a hoisting machine M for moving the elevator car 1 and also control means 3 for controlling the hoisting machine M. The control means 3 are configured to control the speed of the elevator car 1. The elevator further comprises means 10,11 for determining the sway data of the building, which sway data describes the strength of the sway of the building, and means 12 (12*a*, 12*b*) for determining the starting position data of the car, which starting position data contains data about the starting position of the next run of the car and/or data about how long the car has been in the starting position of the next run. The control means 3 are configured to determine the settings for the run speed of the next run on the basis of the aforementioned starting position data and aforementioned sway data. The elevator is controlled with a method in which phase a is performed, wherein the sway data is determined, which sway data describes the strength of the sway of the building, preferably by measuring the sway of the building, preferably the amplitude and/or frequency of the sway of the building, or alternatively the excitation of the sway of the building, such as e.g. wind strength. In addition, phase b is performed, in which the starting position data of the elevator car 1 is determined, which starting position data contains data about the starting position of the elevator car 1 and/or data about how long the elevator car 1 has been in the starting position. After performing phases a and b, the settings for the run speed of the next run are determined on the basis of the starting position data and the sway data. In this way the problematic nature of the sway can be assessed, and the run speed settings of the next run can be selected taking into account the anticipated problematic nature of the sway. The run speed settings are selected both on the basis of car position and on the basis of the sway of the building, the speed of the next run can be limited e.g. setting the maximum speed of the next run and/or final deceleration to be reduced, avoiding unnecessary limitations to run speed. The importance of taking these two variables into account results from the fact that the problematic nature of rope sway has been verified as being strongly dependent on the length of the swaying rope section (which in turn is dependent on car position) and on sway of the building. The criteria for the selection of the speed settings (e.g. whether to limit speed or not) are preferably defined in advance, e.g. before taking the elevator into a run, by determining the problematic combinations of conditions through simulation. The aforementioned simulation can be done also in real-time when there is sufficient processing power to be used for simulation. More precisely, the problematic combinations of starting position data and sway data of the building are determined in advance. Generally problems have been noted to occur when the dimension of the swaying rope section is large, e.g. when the elevator car is stopped at the topmost or bottommost floor landing. There can also be other problematic starting positions. There can be a number of problematic combinations of starting position and building sway. Owing to a certain starting position, a freely hanging rope section of the roping is a certain length, and it has a natural oscillation frequency. When the sway of the building, i.e. an excitation of sway of the roping, happens to correspond to, or approach, the momentary natural oscillation frequency of the roping in its strength (amplitude and/or frequency), the section of free roping can resonate and produce strong swaying in the car. By simulating it is possible to determine for each car position in advance and/or in real-time the problematic strength of sway of the building, or problematic strengths (amplitude and/or frequency) of sway if there are many. It has also been verified that the problematic nature of sway of roping is also affected by the time that the sway has had for developing without interference, e.g. from a change in the dimension of the free section caused by displacement of the car. When the starting position has been the same for a long time, i.e. the car has not moved, the excitation has had time to act on the rope section for a long time and has increased rope sway until the sway reaches a problematic level. In addition, a time can be determined for each car position, which time the car can spend in the starting position without overstrong rope sway being expected. The time is determined for this purpose preferably in advance as a function of starting position data and sway data. As described above, by simulating it is possible to determine how large the problems caused by starting of the elevator car would be in different conditions. Based on simulations or calculations, it is possible to determine the criteria (e.g. values) that when the starting position data and sway data simultaneously fulfill them the speed settings of the next run of the elevator car are set to be reduced, preferably to be reduced in respect of maximum speed and/or final deceleration. The simulation can be performed with software according to some prior art. The criteria selected on the basis of the simulation can be entered into the elevator control in connection with installation. Alternatively, the control means of the elevator can perform the simulation themselves, possibly between runs, before the start of the next run, thus determining themselves the criteria for the run to start. Alternatively, again, the determination of the values of the criteria can be performed, instead of through software simulation, by experimentation or by monitoring the sway behavior of the elevator in operation and of the building over a longer time span.

Figure 2:
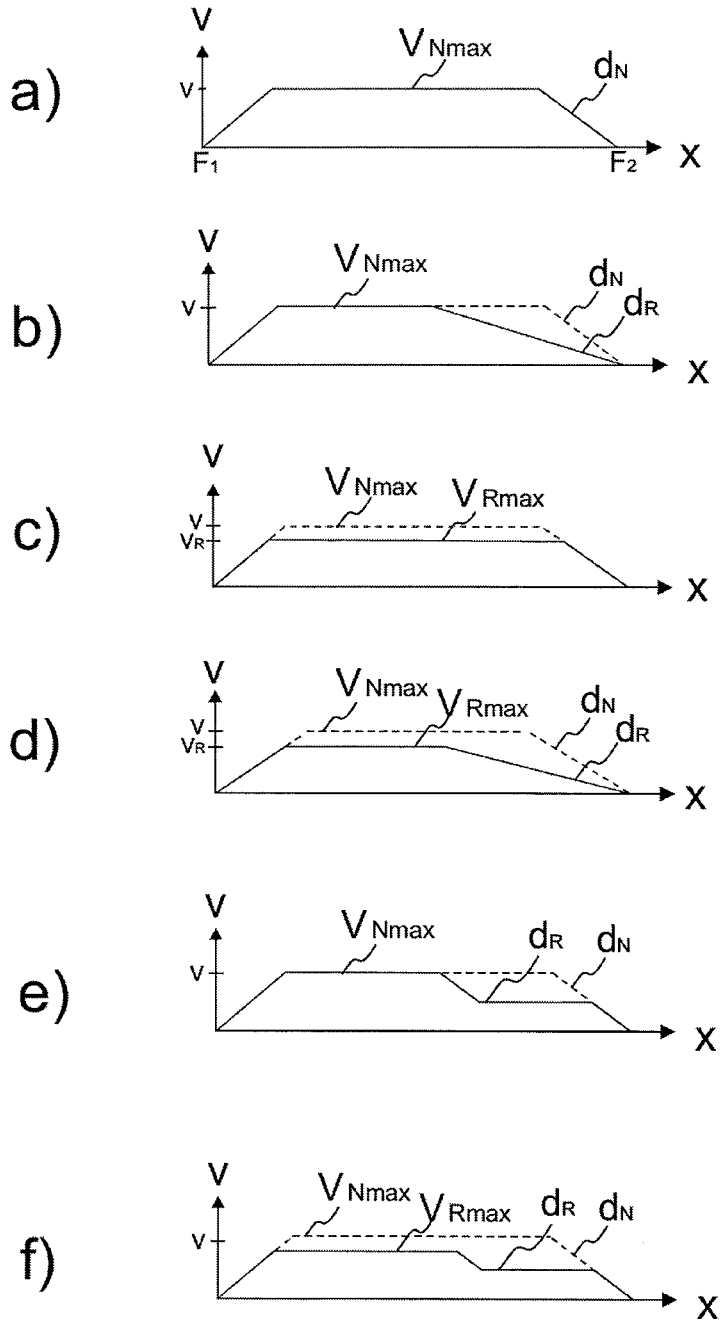
FIG. 2*a* presents a method according to the invention and one preferred run speed curve of the elevator as a function of the position of the elevator car, when the maximum speed and the final deceleration of the run are unreduced.
FIG. 2*b* presents a method according to the invention and one preferred run speed curve of the elevator as a function of the position of the elevator car, when the final deceleration of the run is reduced.
FIG. 2*c* presents a method according to the invention and one preferred run speed curve of the elevator as a function of the position of the elevator car, when the maximum speed of the run is reduced.
FIG. 2*d* presents a method according to the invention and one preferred run speed curve of the elevator as a function of the position of the elevator car, when the final deceleration of the run is reduced.
FIG. 2*e* presents a method according to the invention and one preferred run speed curve of the elevator as a function of the position of the elevator car, when the final deceleration of the run is reduced.
FIG. 2*f* presents a method according to the invention and one preferred run speed curve of the elevator as a function of the position of the elevator car, when the final deceleration of the run is reduced.

In phase c the settings for the run speed of the next run are determined on the basis of the starting position data and the sway data of the building determined earlier. In a preferred embodiment in phase c the maximum speed of the next run and/or the final deceleration of the next run are set for the elevator car 1 on the basis of the starting position data and the sway data. In this way, on the basis of the starting position data and the sway data, the reduced maximum speed and/or the final deceleration of the next run can be selected according to the problematic nature of the sway. FIGS. 2*b*-2*f* present preferred combinations, according to which the maximum speed and/or the final deceleration of the next run can be reduced. By reducing the maximum speed of a run, car vibration and dangerous situations caused by sway can be reduced compared to unreduced speed, because additional time for quenching can in this way be given to the rope sway. In this way an elevator can continue to serve passengers despite sway. It is, of course, advantageous that the control means prevent even a run of the elevator car having reduced speed settings if the sway data alone indicates that the sway is very strong. By affecting the final deceleration of a run, the quenching of rope sway can be controlled. During a run, the length of a freely swaying rope section changes. When the elevator car 1 is driving towards an end of its range of movement, the freely swaying rope section between the elevator car 1 and the end in question shortens at an accelerated rate when driving at constant speed. Owing to this phenomenon, sway of the rope section in question can be transmitted to the car, strengthening the vibration as the elevator car approaches the end. By reducing the final deceleration of the elevator car 1, additional time for quenching can be given to the freely swaying rope section. Final deceleration can be significantly reduced also, in which case the final deceleration differs significantly from the normal final deceleration occurring in connection with arrival at a floor level. Final deceleration can be implemented e.g. in steps or steplessly. FIG. 2*b* presents an embodiment of a reduced stepless final deceleration $d_R$. FIG. 2*e* presents an embodiment of a reduced stepped final deceleration $d_R$. In the figures, the unreduced final deceleration $d_N$ according to unreduced speed settings is presented with a dashed line. FIG. 2*c* presents a preferred embodiment of what a run speed profile is preferably like when the maximum run speed has been reduced $V_{Rmax}$. FIGS. 2*d* and 2*f* present what a run speed profile is preferably like when the maximum run speed has been reduced $V_{Rmax}$ and the final deceleration has been reduced $d_R$. In the figures, $V_{Nmax}$ describes the unreduced maximum speed of a run and $d_N$ the unreduced final deceleration. The unreduced maximum speed $V_{Nmax}$ is preferably the nominal speed of the elevator. $V_{Nmax}$ is preferably the highest even speed during a run. Final deceleration is preferably the deceleration to zero speed after the maximum even speed during a run. In FIGS. 2*a*-2*f* V describes the speed of the elevator car and X the absolute position of the elevator car.

Means for determining the sway data of the building are connected to the control means 3, which sway data describes the strength of the sway of the building. Sway of the building is the most significant excitation of sway of the ropes of the roping. The state of rope sway (e.g. amplitude, wavelength, frequency) can be very straightforwardly deduced from the sway data of the building, when the dimension of the freely hanging rope section is known. The aforementioned means for determining the sway data preferably comprise an acceleration sensor 10 in the top parts of the building, preferably in the proximity of the top end of the range of movement of the elevator car. The acceleration sensor produces data, on the basis of which the control means 3 determine directly the amplitude and/or frequency of the sway of the building. In addition, or alternatively, the means for determining sway data comprise wind-speed measuring means 11 for measuring the excitation of the sway of the building. The sway of a building can be deduced on the basis of the excitation of sway of the building, e.g. based on tests, for instance by measuring the effect of different wind conditions on the sway of the building or directly on the sway of the roping. The elevator also comprises means 12 for determining the starting position data of the car, which starting position data contains data about the starting position of the car and/or data about how long the car has been in the starting position. The time determination function is preferably a part of the control means 3, and can in practice comprise a clock or other method for determining the time that has passed. The means for determining starting position data can comprise any method according to prior art to determine the position of the elevator car. As presented in FIG. 1, the solution can comprise a unit 12*a* on the elevator car 1, which unit comprises a transmitter and detection means, and sensors 12*b* on the floor landings. There are numerous alternative ways for determining the position of the elevator car. For receiving starting position data and sway data, the control means comprise inputs for these data. The data can arrive processed or unprocessed, where processing means converting the measurement of sway/starting position into a comparable value.

In a preferred embodiment in phase c a reduced maximum speed $V_{Rmax}$ of the next run and/or a reduced final deceleration $d_R$ of the next run are set for the elevator car 1 if the determined value of the sway data exceeds the limit value and the starting position data, more particularly the starting position and/or the stopover time of the car in the starting position, simultaneously fulfill certain criteria.

If the criteria are not fulfilled, it is not needed to limit the run speed, i.e. to set for the next run a reduced maximum speed $V_{Rmax}$ of the next run and/or a reduced final deceleration $d_R$ of the next run. For example, an unreduced maximum speed $V_{Nmax}$ of the next run and/or an unreduced final deceleration $d_N$ of the next run are set for the elevator car if the determined value of the sway data exceeds the limit value but the starting position data simultaneously does not indicate that the elevator car is, or has been before the car starts to move, stopped for a certain time at the bottom end or top end of its range of movement, and/or if the value of the sway data does not exceed a predefined value. In this way the run speed of an elevator car can be limited simply according to the correct need. If the run speed settings for the next run are set on the basis of sway data and starting position and the time spent by the car in the starting position, a good end result is achieved very simply.

It is taken into account in the solution that certain starting positions are more critical than others from the viewpoint of rope sway and thus of the next run. When the ends of the range of movement of the elevator car are more critical, it is advantageous that in phase c a reduced maximum speed $V_{Rmax}$ of the next run and/or a reduced final deceleration $d_R$ of the next run are set for the elevator car 1 if the determined value of the sway data exceeds the limit value (e.g. exceeds a predefined value) and the car position data simultaneously indicates that the elevator car is, or has been before the car starts to move, stopped for a certain time at the bottom end or top end of its range of movement (e.g. of the elevator hoistway), preferably at the point of the bottommost floor landing or at the point of the topmost floor landing. If the criteria are not fulfilled, the run speed does not need to be limited and thus it is possible to drive at the normal maximum speed $V_{Nmax}$ and with the normal unreduced final deceleration $d_N$. For example, an unreduced maximum speed $V_{Nmax}$ of the next run and/or an unreduced final deceleration $d_N$ of the next run are set for the elevator car if the determined value of the sway data exceeds the limit value but the starting position data simultaneously does not indicate that the elevator car is, or has been before the car starts to move, stopped for a certain time at the bottom end or top end of its range of movement, and/or if the value of the sway data does not exceed a predefined value. In practice the method can be implemented by setting the control means 3 before phase c to compare the determined sway data to a limit value, the magnitude of which limit value is selected on the basis of the determined car position from a plurality of limit values, preferably such that the limit value is lower with a starting position of the elevator car which is at the bottom end or at the top end of the range of movement of the elevator car than with a starting position which is between the bottom end and top end of the range of movement of the elevator car. As referred to earlier, a simulation or other aforementioned way can be used for determining the limit values, so that the magnitude of the sway that would cause problems in the situation of the next drive is known.

The functions of the control means 3 are described in the preceding. More precisely, structurally the control means can be e.g. of the following type. They can be a part of the elevator control, e.g. a part of an elevator control unit, which is connected to the hoisting machine of the elevator, such as to an electric motor. The control means are configured to perform the phases of a method according to what is defined above. In a preferred embodiment, the control means are configured to set for the elevator car 1 the maximum speed of the next run and/or the final deceleration of the next run on the basis of the aforementioned starting position data and sway data, more particularly to set a reduced maximum speed for the elevator car 1 if the determined sway data and car position data simultaneously fulfill certain criteria. The control means 3 comprise a logic for selecting the speed settings of the next run on the basis of sway data and of car position. For this purpose the control means can comprise a computer or a processor unit and a memory. Preferably the control means 3 comprise a memory, which stores the speed settings of the elevator car as a function of sway data and of car position.

The same optimal end result can be reached in a number of ways. For example 1) a reduced maximum speed is used for the whole trip
2) a reduced maximum speed is used for the end trip
3) final deceleration is reduced The control system selects the optimal solution. The optimal solution might vary, for instance according to the sway of the building, the degree of loading of the car, the traffic situation, et cetera.

In this application, the term maximum speed means the highest speed of the next run of the elevator car, preferably the speed of the even speed range of the next run of the elevator car. The term starting position means the floor landing of the elevator at the point of which a stopped elevator car was stopped before the beginning of the next run. In the preferred embodiment presented only two floor landings are presented. The solution could be utilized regardless of the number of floor landings. The functions and features presented are at their most advantageous when the starting position is at an end of the range of movement of the elevator car. That being the case, the elevator can be an elevator moving between only two positions (floor landings), e.g. a so-called shuttle elevator, in which case the travel heights are large and the sway problem significant. Also the distances travelled by the elevator are large and there generally is time to reach a high peak speed during the trip, in which case the high speed could cause a dangerous situation in a sway situation. The building is preferably a high-rise building.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. Method for controlling an elevator installed in a building, which elevator comprises an elevator car, which is arranged to travel in the elevator hoistway between floor landings that are at different heights, one or more ropings connected to the elevator car, preferably at least a roping, supported by which the elevator car is suspended, a hoisting machine for moving the elevator car, control means for controlling the hoisting machine, in which method these phases are performed:

a) the sway data of the building is determined, which data describes the strength of the sway of the building, preferably by measuring the sway of the building or the excitation of the sway of the building, and b) the starting position data of the elevator car is determined, which starting position data contains data about the starting position of the elevator car and/or data about how long the elevator car has been in the starting position, and c) after performing phases a and b, the settings for the run speed of the next run are determined on the basis of the aforementioned starting position data and the aforementioned sway data.

2. Method according to claim 1, wherein in phase c the maximum speed of the next run and/or the final deceleration of the next run are set for the elevator car on the basis of the starting position data and the sway data.

3. Method according to claim 1, wherein in phase a the sway of the building or the excitation of the sway is measured for determining the sway data of the building, preferably measuring the amplitude and/or frequency of the sway, or the wind speed.

4. Method according to claim 1, wherein in phase c a reduced maximum speed of the next run and/or a reduced final deceleration of the next run are set for the elevator car, if the determined value of the sway data and the starting position data simultaneously fulfill certain criteria.

5. Method according to claim 1, wherein in phase c a reduced maximum speed of the next run and/or a reduced final deceleration of the next run are set for the elevator car if the determined value of the sway data exceeds the limit value and the car position data simultaneously indicates that the elevator car is, or has been before the car starts to move, stopped for a certain time at the bottom end or top end of its range of movement, preferably at the point of the bottommost floor landing or at the point of the topmost floor landing.

6. Method according to claim 1, wherein before phase c the determined sway data is compared to the limit value, the magnitude of which limit value is selected on the basis of the starting position data from a plurality of limit values, which plurality of limit values is preferably such that the limit value is lower with a starting position of the elevator car which is at the bottom end or at the top end of the range of movement of the elevator car than with a starting position which is between the bottom end and top end of the range of movement of the elevator car.

7. Method according to claim 1, wherein for the elevator car is set a reduced maximum speed of the next run and/or a reduced final deceleration of the next run if the determined value of the sway data exceeds the limit value and the starting position data simultaneously indicates that the elevator car is, or has been before the car starts to move, stopped for a certain time at the bottom end or top end of its range of movement, preferably at the point of the bottommost floor landing or at the point of the topmost floor landing, and an unreduced maximum speed and/or an unreduced final deceleration of the next run if the determined value of the sway data exceeds the limit value but the starting position data simultaneously does not indicate that the elevator car is, or has been before the car starts to move, stopped for a certain time at the bottom end or top end of its range of movement, and/or if the value of the sway data does not exceed a predefined value.

8. Elevator, which is installed in a building, and which elevator comprises an elevator car which is arranged to travel in the elevator hoistway between floor landings that are at different heights, roping, which is connected to the elevator car, a hoisting machine for moving the elevator car, control means for controlling the hoisting machine, which control means are configured to control the speed of the elevator car, means for determining the sway data of the building, which sway data describes the strength of the sway of the building, means for determining the starting position data of the car, which starting position data contains data about the starting position of the elevator car and/or data about how long the elevator car has been in the starting position, wherein the control means are configured to determine the settings for the run speed of the next run on the basis of the aforementioned starting position data and aforementioned sway data.

9. Elevator according to claim 8, wherein the control means are configured to set for the elevator car the maximum speed of the next run and/or the final deceleration of the next run on the basis of the aforementioned starting position data and sway data.

10. Elevator according to claim 8, wherein the control means are configured to set a reduced maximum speed for the elevator car, if the determined sway data and car position data simultaneously fulfill certain criteria.

11. Elevator according to claim 8, wherein the control means are configured to perform a method for controlling an elevator installed in a building, which elevator comprises an elevator car, which is arranged to travel in the elevator hoistway between floor landings that are at different heights, one or more ropings connected to the elevator car, preferably at least a roping, supported by which the elevator car is suspended, a hoisting machine for moving the elevator car, control means for controlling the hoisting machine, in which method these phases are performed:

d) the sway data of the building is determined, which data describes the strength of the sway of the building, preferably by measuring the sway of the building or the excitation of the sway of the building, and e) the starting position data of the elevator car is determined, which starting position data contains data about the starting position of the elevator car and/or data about how long the elevator car has been in the starting position, and f) after performing phases a and b, the settings for the run speed of the next run are determined on the basis of the aforementioned starting position data and the aforementioned sway data.

12. Elevator according to claim 8, wherein the control means comprise a logic for selecting the speed settings of the next run on the basis of sway data and of car position.

13. Elevator according to claim 8, wherein the control means comprise a memory, which stores the speed settings of the elevator car as a function of sway data and of car position.

14. Elevator according to claim 8, wherein the elevator car is suspended supported by the aforementioned roping.

15. Method according to claim 2, wherein in phase a the sway of the building or the excitation of the sway is measured for determining the sway data of the building, preferably measuring the amplitude and/or frequency of the sway, or the wind speed.

16. Method according to claim 2, wherein in phase c a reduced maximum speed of the next run and/or a reduced final deceleration of the next run are set for the elevator car, if the determined value of the sway data and the starting position data simultaneously fulfill certain criteria.

17. Method according to claim 3, wherein in phase c a reduced maximum speed of the next run and/or a reduced final deceleration of the next run are set for the elevator car, if the determined value of the sway data and the starting position data simultaneously fulfill certain criteria.

18. Method according to claim 2, wherein in phase c a reduced maximum speed of the next run and/or a reduced final deceleration of the next run are set for the elevator car if the determined value of the sway data exceeds the limit value and the car position data simultaneously indicates that the elevator car is, or has been before the car starts to move, stopped for a certain time at the bottom end or top end of its range of movement, preferably at the point of the bottommost floor landing or at the point of the topmost floor landing.

19. Method according to claim 3, wherein in phase c a reduced maximum speed of the next run and/or a reduced final deceleration of the next run are set for the elevator car if the determined value of the sway data exceeds the limit value and the car position data simultaneously indicates that the elevator car is, or has been before the car starts to move, stopped for a certain time at the bottom end or top end of its range of movement, preferably at the point of the bottommost floor landing or at the point of the topmost floor landing.

20. Method according to claim 4, wherein in phase c a reduced maximum speed of the next run and/or a reduced final deceleration of the next run are set for the elevator car if the determined value of the sway data exceeds the limit value and the car position data simultaneously indicates that the elevator car is, or has been before the car starts to move, stopped for a certain time at the bottom end or top end of its range of movement, preferably at the point of the bottommost floor landing or at the point of the topmost floor landing.

* * * * *